US006363688B1

(12) United States Patent
Weder et al.

(10) Patent No.: US 6,363,688 B1
(45) **Date of Patent: *Apr. 2, 2002**

(54) METHOD FOR PROVIDING A DECORATIVE COVERING FOR A FLOWER POT

(75) Inventors: Donald E. Weder, Highland; Sonny K. Burnside, Wheaton, both of IL (US)

(73) Assignee: Southpac Trust International, Inc., Rarotonga (CK)

( * ) Notice: Subject to any disclaimer, the term of this patent is extended or adjusted under 35 U.S.C. 154(b) by 0 days.

This patent is subject to a terminal disclaimer.

(21) Appl. No.: 09/613,955

(22) Filed: Jul. 11, 2000

Related U.S. Application Data

(60) Continuation of application No. 09/188,875, filed on Nov. 9, 1998, now Pat. No. 6,119,436, which is a division of application No. 08/832,552, filed on Apr. 3, 1997, now abandoned.

(51) Int. Cl.[7] ..... B65B 11/00; B65B 67/08

(52) U.S. Cl. ..... 53/397; 53/461; 53/390

(58) Field of Search ..... 53/397, 399, 461, 53/462, 464, 465, 219, 390; 47/72; 206/423, 449, 451; 224/255, 673, 933, 907, 677

(56) References Cited

U.S. PATENT DOCUMENTS

| | | | |
|---|---|---|---|
| 682,817 | A | 9/1901 | Shaver |
| 732,889 | A | 7/1903 | Paver |
| 794,347 | A | 7/1905 | Crouse |
| 1,525,015 | A | 2/1925 | Weeks |
| 1,572,548 | A | 2/1926 | Mattison |
| 1,661,479 | A | 3/1928 | Josephson |
| 1,794,212 | A | 2/1931 | Snyder |
| 1,863,216 | A | 6/1932 | Wordingham |
| 1,868,853 | A | 7/1932 | Sievers |
| 1,892,818 | A | 1/1933 | Trew |
| 1,925,176 | A | 9/1933 | Dean |
| 1,946,569 | A | 2/1934 | Clark |
| 1,978,631 | A | 10/1934 | Herrlinger |
| 1,988,886 | A | 1/1935 | Wilson |
| 2,048,123 | A | 7/1936 | Howard |
| 2,152,323 | A | 3/1939 | Moore |
| 2,170,147 | A | 8/1939 | Lane |
| 2,209,778 | A | 7/1940 | Krasowski |
| 2,248,687 | A | 7/1941 | Nakahiro |
| 2,278,673 | A | 4/1942 | Savada et al. |
| 2,363,761 | A | 11/1944 | Ward |

FOREIGN PATENT DOCUMENTS

| | | |
|---|---|---|
| EP | 0050990 | 5/1982 |
| FR | 1557833 | 1/1969 |
| FR | 2150897 | 4/1973 |
| GB | 28130 | 9/1907 |
| GB | 158098 | 1/1921 |

OTHER PUBLICATIONS

Speed Sheets and Speed Rolls Brochure, Highland Supply Corporation, ©1990.

Speed Sheets and Speed Rolls Brochure, Highland Supply Corporation, ©1991.

Speed Cover Brochure, "The Simple Solution for Those Peak Volume Periods", Highland Supply Corp., ©1989.

*Primary Examiner*—Stephen F. Gerrity
(74) *Attorney, Agent, or Firm*—Dunlap, Codding & Rogers, P.C.

(57) ABSTRACT

The present invention relates to a method for providing a decorative covering for a flower pot. The method includes the step of providing a decorative covering assembly comprising a header assembly and at least one sheet of material detachably connected to the header assembly. The header assembly is secured to a holder assembly such that the decorative covering assembly is supported by the holder assembly and at least one sheet of material can be detached from the header assembly. At least one sheet of material is detached from the header assembly and is disposed about at least a portion of the flower pot to provide a decorative covering for the flower pot.

16 Claims, 4 Drawing Sheets

2,371,985 A 3/1945 Freiberg
2,391,125 A 12/1945 Carpenter
2,449,334 A 9/1948 Smith
2,529,060 A 11/1950 Trillich
2,536,773 A 1/1951 Saidel
2,539,242 A 1/1951 Foss
2,785,508 A 3/1957 Coleman, Jr.
2,822,287 A 2/1958 Avery et al.
2,840,962 A 7/1958 Stremke et al.
2,846,060 A 8/1958 Young
2,906,069 A 9/1959 Page et al.
2,987,402 A 6/1961 Dold et al.
3,031,818 A 5/1962 Meyer et al.
3,058,263 A 10/1962 Reynolds
3,121,647 A 2/1964 Harris et al.
3,130,113 A 4/1964 Silman
3,271,922 A 9/1966 Wallerstein et al.
3,285,406 A * 11/1966 Winesett ..... 224/677 X
3,299,612 A 1/1967 Bernhardt
3,314,211 A 4/1967 Wolff
3,389,784 A 6/1968 Hendricks et al.
3,503,759 A 3/1970 Wilton
3,508,372 A 4/1970 Wallerstein et al.
3,514,012 A 5/1970 Martin
3,620,366 A 11/1971 Parkinson
3,717,244 A 2/1973 Smith
3,778,324 A 12/1973 Lavigne
3,793,799 A 2/1974 Howe et al.
3,830,035 A 8/1974 Hoover
3,962,503 A 6/1976 Crawford
3,988,873 A 11/1976 Oliverius
3,991,881 A 11/1976 Augurt
4,054,697 A 10/1977 Reed et al.
4,091,925 A 5/1978 Griffo et al.
4,104,845 A 8/1978 Hoffmann
4,171,085 A 10/1979 Doty
4,172,349 A 10/1979 Lipes
4,216,620 A 8/1980 Weder et al.
4,251,552 A 2/1981 Uno et al.
4,277,930 A 7/1981 Nausedas et al.
4,333,267 A 6/1982 Witte
4,379,101 A 4/1983 Smith
4,380,564 A 4/1983 Cancio et al.
4,413,725 A 11/1983 Bruno et al.
4,458,466 A 7/1984 Carbone et al.
4,546,875 A 10/1985 Zweber
4,590,109 A 5/1986 Holmberg
4,686,814 A 8/1987 Yanase
4,733,521 A 3/1988 Weder et al.
4,750,668 A 6/1988 Behne et al.
4,765,464 A 8/1988 Ristvedt
4,773,182 A 9/1988 Weder et al.
4,846,586 A 7/1989 Bruno
4,863,084 A 9/1989 Nabozny
4,897,983 A 2/1990 Hogenkamp et al.
5,007,229 A 4/1991 Weder et al.
5,094,060 A 3/1992 Caird
5,111,638 A 5/1992 Weder
5,167,974 A 12/1992 Grindrod et al.
5,181,364 A 1/1993 Weder
5,182,895 A 2/1993 Lugo
5,195,271 A 3/1993 Bradley, Jr.
5,205,108 A 4/1993 Weder et al.
5,235,782 A 8/1993 Landau
5,245,814 A 9/1993 Weder
5,311,991 A 5/1994 Weder et al.
5,315,785 A 5/1994 Avot et al.
5,332,610 A 7/1994 Weder et al.
5,344,016 A 9/1994 Weder et al.
5,345,745 A 9/1994 Weder
5,448,875 A 9/1995 Weder
5,450,707 A 9/1995 Weder et al.
5,473,856 A 12/1995 Weder
5,479,761 A 1/1996 Weder
5,699,647 A 12/1997 Weder et al.
6,088,997 A * 7/2000 Weder et al. ..... 53/397

* cited by examiner

METHOD FOR PROVIDING A DECORATIVE COVERING FOR A FLOWER POT

CROSS-REFERENCE TO RELATED APPLICATIONS

This is a continuation of U.S. application Ser. No. 09/188,875, entitled METHOD FOR PROVIDING A DECORATIVE COVERING FOR A FLOWER POT, which was filed on Nov. 9, 1998 (now U.S. Pat. No. 6,119,436); which is a divisional of U.S. Ser. No. 08/832,552, abandoned, entitled METHOD FOR PROVIDING A DECORATIVE COVERING FOR A FLOWER POT which was filed on Apr. 3, 1997 and which is hereby incorporated herein by reference.

STATEMENT REGARDING FEDERALLY SPONSORED RESEARCH OR DEVELOPMENT

Not applicable.

BACKGROUND OF THE INVENTION

Field of the Invention

The present invention relates to a method for providing a covering for a container and more particularly, but not by way of limitation, to a method for providing a decorative covering for a flower pot wherein at least one sheet of material is detached from a decorative covering assembly and disposed about the flower pot to provide the decorative covering for the flower pot. In one aspect, the present invention relates to a method for providing a decorative covering for a flower pot wherein a cover bottom is disposed about a lower end of the flower pot.

BRIEF SUMMARY OF THE INVENTION

The present invention relates generally to a method for providing a decorative covering for a flower pot having an upper end, a lower end, a bottom, and a sidewall extending generally between the upper end and the lower end thereof. Broadly, the method provides a decorative covering assembly comprising a header assembly and at least one sheet of material detachably connected to the header assembly. For ease of use, the header assembly is secured to a holder assembly such that the decorative covering assembly is supported by the holder assembly and at least one sheet of material can be detached from the header assembly. At least one sheet of material is then detached from the header assembly and thereafter disposed about at least a portion of the flower pot to provide the decorative covering for the flower pot.

An object of the present invention is to provide an improved method of providing the decorative covering for the flower pot.

Other objects, features and advantages of the present invention will be apparent to those skilled in the art from the following detailed description when read in conjunction with the accompanying drawings and appended claims.

DETAILED DESCRIPTION OF THE INVENTION

Definitions

Figure 1:
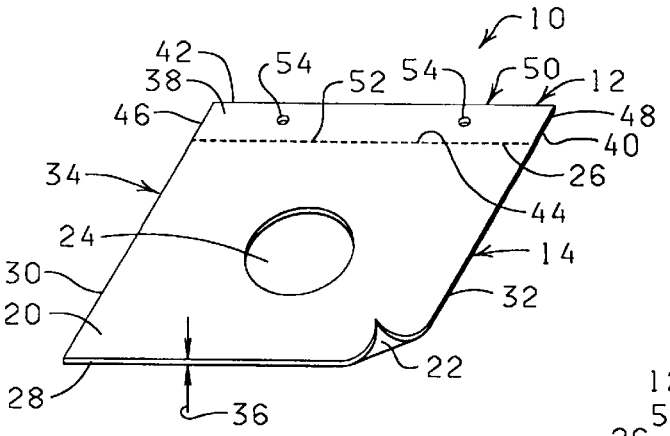
FIG. 1 is a perspective view of a decorative covering assembly constructed in accordance with the present invention, the decorative covering assembly including a header assembly and at least one sheet of material detachably connected to the header assembly.

The term "holder assembly" as used herein refers to any device which can be used for supporting a decorative covering assembly such that one or more sheets of material can be detached from the decorative covering assembly and positioned about a flower pot or a floral grouping to provide a decorative covering thereabout. The holder assembly may be provided with wheels or attached to individuals so as to make the holder assembly transportable from one location to another.

The term "decorative covering" or "decorative cover" as used herein refers to a cover formed by at least one sheet of material which is disposed about a flower pot or a floral grouping.

The term "floral grouping" as used herein refers to a single flower, foliage, a botanical item, a propagule, cut flowers, artificial flowers, and/or other fresh and/or artificial plants or floral materials, including secondary plants, growing potted plants having a root portion and/or other ornamentation which adds to the aesthetic qualities of the overall floral grouping. The term "floral grouping" may be interchanged with the term "floral arrangement". The term "floral grouping" as used herein may also refer to a "floral grouping", as defined above, which is disposed within a pot or a flower pot.

The term "pot" or "flower pot" as used herein refers to any container or pot-type container which can be used for holding and/or supporting floral groupings. Examples of pots and flower pots include, but are not limited to, clay pots, wooden pots, plastic pots, pots made from natural and/or synthetic fibers, or combinations thereof.

The term "cover bottom" as used herein refers to any container or decorative covering capable of being disposed about and substantially encompassing at least a lower end of another container, such as a pot or flower pot. The cover bottom may be a preformed container or the cover bottom may be formed of one or more sheets of material which are disposed about the lower end of the pot, flower pot, or container.

The term "bonding material" as used herein refers to any adhesive or cohesive including pressure sensitive adhesives and co-adhesives. The term "bonding material" as used herein also refers to materials which are heat sealable, sonic sealable, and/or vibratory sealable. For example, the term "bonding material" can refer to a heat sealing lacquer which may be applied to a sheet of material and effectively bonded thereto by heat, sound waves, or vibrations.

The term "bonding material" as used herein also refers to any type of material or device which can be used to effect the bonding or connecting of two adjacent portions of a sheet of material to effect the connection or bonding described herein. Thus, the term "bonding material" can refer to ties, labels, band, ribbons, strings, tape, staples, and combinations thereof.

The term "bonding material" as used herein also refers to any heat or chemically shrinkable material, electrical bonding means such as static electricity, magnetic bonding means, mechanical or barb-type fastening means, clamping means, curl-type characteristics of a film means, materials incorporated into the sheet of material which can cause the sheet of material to take on certain shapes, and any type of welding methods which may weld portions of the sheet to itself and/or other sheets.

The term "polymer film" as used herein refers to a film formed of synthetic polymers such as polypropylene or naturally occurring polymers such as cellophane, which are relatively strong and not subject to tearing (substantially non-tearable). Various types of "polymer films" are described in U.S. Pat. No. 5,311,991, issued to Weder et al. on May 17, 1994 which is hereby incorporated herein by reference.

The terms "cling wrap" or "cling material" as used herein refer to any material which is capable of connecting a sheet of material to itself when such material is wrapped about an item, such as a flower pot or a floral grouping. The terms "cling wrap" or "cling material" are defined in detail in U.S. Pat. No. 5,311,991 issued to Weder et al. on May 17, 1994 which is incorporated herein by reference.

FIGS. 1–7

Figure 5:
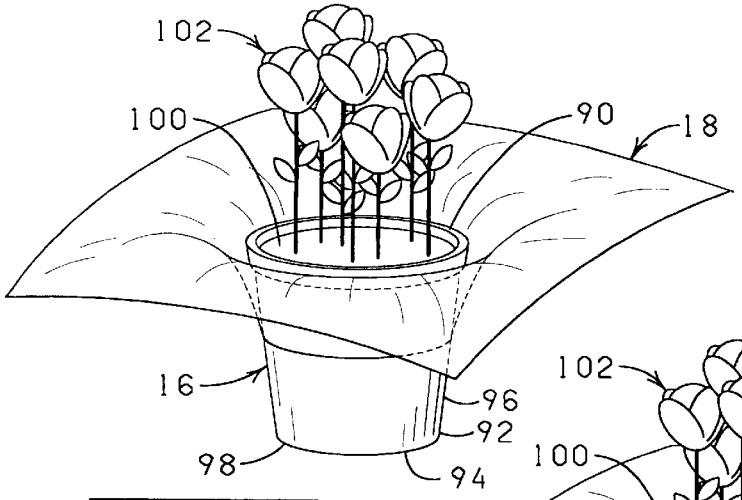
FIG. 5 is a perspective view of a sheet of material detached from the decorative covering assembly of FIG. 4 wherein the sheet of material is disposed about a flower pot to provide a decorative covering for the flower pot.

Referring now to the drawings and more particularly to FIG. 1, shown therein and designated by the general reference numeral 10 is a decorative covering assembly which is constructed in accordance with the present invention. The decorative covering assembly includes a header assembly 12 and at least one substantially flexible sheet of material 14 which is detachably connected to the header assembly 12 such that the sheet of material 14 can be detached from the header assembly 12 and disposed about a flower pot 16 to form a decorative covering 18 thereabout substantially as shown in FIG. 5. It should be noted that only one sheet of material 14 and one header assembly 12 are shown in FIG. 1 for purposes of clarity.

The sheet of material 14 has an upper surface 20, a lower surface 22 and an opening 24 formed through a portion thereof. The opening 24 is shaped and dimensioned to matingly receive at least a portion of the flower pot 16 such that upon positioning at least a portion of the flower pot 16 through the opening 24, the sheet of material 14 extends over at least a portion of the flower pot 16 and forms the decorative covering 18 for the flower pot 16 substantially as shown in FIG. 5. The sheet of material 14 is also provided with a first end 26, an opposed second end 28 spaced a distance from the first end 26, a first side 30, and an opposed second side 32 spaced a distance from the first side 30. The first end 26, the second end 28, the first side 30 and the second side 32 cooperate to provide the sheet of material 14 with a periphery 34. The sheet of material 14 has a substantially planar cross-section.

The sheet of material 14 is a relatively thin sheet of material having a thickness 36 in the range of from about 0.1 mils to about 30 mils and more desirably from about 1.0 mils to about 10.0 mils. However, it should be understood that the thickness 36 of the sheet of material 14 may vary depending on the type of material and it should be understood that the sheet of material 14 can have any thickness so long as the sheet of material 14 retains sufficient flexibility and foldability so that the sheet of material 14 can be disposed about an object to be covered, such as the flower pot 16 and shaped to form the decorative covering 18 thereabout. For example, the sheet of material 14 can be constructed of any of the materials selected from a group of materials comprising paper, foil, natural organic polymer films, man-made organic polymer films, cling wrap, cloth (natural or synthetic), burlap (natural or synthetic) and/or combinations thereof.

Although the sheet of material 14 has been shown and described herein as having a substantially square shape, it should be understood that the sheet of material 14 may assume any geometric, non-geometric, asymmetrical or fanciful shape having any appropriate size so long as the sheet of material 14 can be disposed about the flower pot 16 to form the decorative covering 18 thereabout. For example, the sheet of material 14 may be square, rectangular, circular, heart-shaped or the like.

The header assembly 12 of the decorative covering assembly 10 is detachably connected to the first end 26 of the sheet of material 14, generally between the first side 30 and the second side 32 thereof. The header assembly 12 has an upper surface 38, a lower surface 40, a first end 42, an opposed second end 44 spaced a distance from the first end 42, a first side 46, and an opposed second side 48 spaced a distance from the first side 46. The first end 42, the second end 44, the first side 46 and the second side 48 cooperate to provide the header assembly 12 with a periphery 50. A line of perforations 52 is provided between the second end 44 of the header assembly 12 and the first end 26 of the sheet of material 14 so that the sheet of material 14 can be readily detached from the header assembly 12 and positioned about the flower pot 16 to form the decorative covering 18 for the flower pot 16 substantially as shown in FIG. 5. The header assembly 12 is provided with a plurality of spatially disposed holes 54 extending between the upper surface 38 and the lower surface 40 thereof for a purpose to be described hereinafter.

Figure 2:
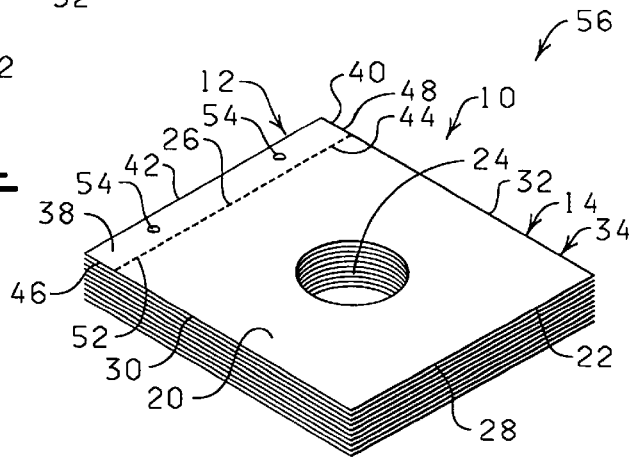
FIG. 2 is a perspective view of the decorative covering assembly of FIG. 1 wherein a plurality of sheets of material are connected to the header assembly to form a pad.

Referring now to FIG. 2, the decorative covering assembly 10 of the present invention contemplates a plurality of sheets of material 14 stacked one on top of the other and detachably connected to the header assembly 12 to form a pad 56 substantially as shown in FIG. 2. In one embodiment (which is shown in FIGS. 2, 3 and 4), each sheet of material 14 has one respective header assembly 12 connected thereto and each sheet of material 14 is positioned such that the first end 42 of the header assembly 12, the first side 30 of the sheet of material 14, the second side 32 of the sheet of material 14 and the second end 28 of each of the sheets of material 14 are generally aligned.

Figure 3:
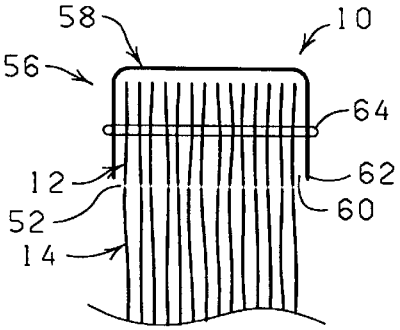
FIG. 3 is a partial, side elevational view of the decorative covering assembly of FIG. 2 wherein a header connector assembly is disposed about the header assembly.

Referring now to FIG. 3, when each sheet of material 14 has the respective header assembly 12 connected thereto, the decorative covering assembly 10 can be further provided with a header connector assembly 58 disposed about the respective header assemblies 12 for supporting the sheets of material 14 and the respective header assemblies 12 and for connecting the respective header assemblies 12 together to facilitate the removal of each sheet of material 14 from its respective header assembly 12. The header connector assembly 58 is shaped and dimensioned to provide an elongated slot 60 formed through a lower end 62 thereof. The elongated slot 60 receives the respective header assemblies 12 of the decorative covering assembly 10 therein so that the header connector assembly 58 extends over and substantially encompasses the respective header assemblies 12 substantially as shown in FIG. 3. A bonding material is provided for connecting the respective header assemblies 12 together. As shown in FIG. 3, the bonding material can be a staple 64 disposed through the header connector assembly 58 and the respective header assemblies 12 so as to connect the header connector assembly 58 and the respective header assemblies 12 together. However, it should be understood that any bonding material capable of connecting the respective header assemblies 12 together can be utilized by the present invention.

While the header assembly 12 has been shown and described with reference to FIGS. 2 and 3 as a plurality of respective header assemblies 12 which are connected together via the header connector assembly 58, it should be understood that the header assembly 12 can be any suitable means for detachably supporting at least one sheet of material 14 such that the sheet of material 14 can be removed therefrom and disposed about the flower pot 16 for providing the decorative covering 18 thereabout. For example, the header assembly 12 may be a single body member such as shown in FIG. 1, which detachably supports at least one sheet of material 14 via a bonding material (not shown), such as an adhesive which is applied generally between a portion of the periphery 34 of the sheet of material 14 and the header assembly 12.

Figure 4:
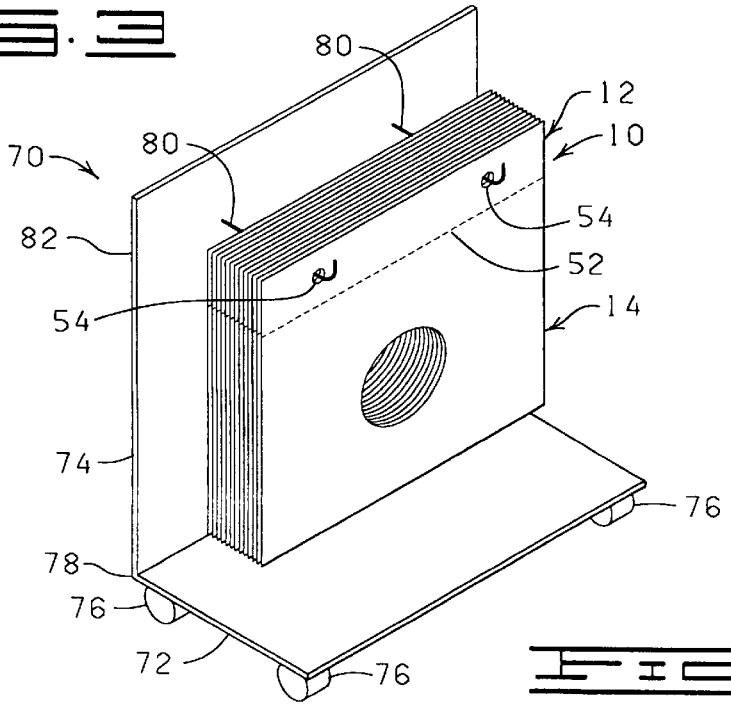
FIG. 4 is a perspective view of a holder assembly which is constructed in accordance with the present invention and which has the decorative covering assembly of FIG. 2 attached thereto.

Referring now to FIG. 4, a holder assembly 70 constructed in accordance with the present invention is shown with the decorative covering assembly 10 comprising the plurality of sheets of material 14 attached thereto via their respective header assemblies 12. The holder assembly 70 is provided with a base member 72, a substantially upright member 74 extending upwardly from the base member 72, and a plurality of wheels 76. The base member 72 is connected to a lower end 78 of the substantially upright member 74 such that the upright member 74 extends upwardly from the base member 72 and is supported in a substantially vertical plane. The wheels 76 of the holder assembly 70 are operably connected to the base member 72 so that the holder assembly 70 is selectively movable from one location to another location by an individual, such as when an individual moves the holder assembly 70 through a greenhouse.

A plurality of spatially disposed prongs 80 extend outwardly from an upper portion 82 of the substantially upright member 74 of the holder assembly 70. The prongs 80 are adapted to be disposed through the holes 54 provided in the header assemblies 12 of the decorative covering assembly 10 to connect the header assemblies 12 to the substantially upright member 74 of the holder assembly 70 so that the decorative covering assembly 10 is held in a substantially stable position on the holder assembly 70 during transportation of the holder assembly 70 from one location to another location and so that one or more sheets of material 14 can be detached from its header assembly 12 and disposed about the flower pot 16 (FIG. 5).

Referring now to FIG. 5, the flower pot 16 is depicted as having the sheet of material 14 disposed thereabout so as to provide the decorative covering 18 for the flower pot 16. The flower pot 16 has an upper end 90, a lower end 92, a bottom 94 and a substantially continuous sidewall 96 extending generally upwardly from a periphery 98 of the bottom 94. The bottom 94 and the sidewall 96 cooperate to encompass a receiving space 100 which is adapted to receive a floral grouping 102.

To form the decorative covering 18 about the flower pot 16, an individual grips at least one of the sheets of material 14 of the decorative covering assembly 10 and tears the sheets of material 14 from the header assemblies 12 along the line of perforations 52. The individual then positions the lower end 92 of the flower pot 16 through the openings 24 in the sheets of material 14 such that the sheets of material 14 frictionally engage the sidewall 96 of the flower pot 16 to secure the sheets of material 14 about the flower pot 16 and thereby produce the decorative covering 18 for the flower pot 16.

Alternatively, the individual can form the decorative covering 18 about the flower pot 16 by gripping at least one of the sheets of material 14 and thereafter moving such sheets of material 14 to a horizontally extending position with one hand. In this position, the individual disposes the lower end 92 of the flower pot 16 through the openings 24 in the sheets of material 14 with the other hand such that the flower pot 16 is moved downwardly through the opening 24 until the sheets of material 14 are engaged by the flower pot 16 whereby the weight of the flower pot 16 detaches the sheets of material 14 from the header assembly 12 along the line of perforations 52 and thereby forms the decorative covering 18 about the flower pot 16.

When the decorative covering 18 is disposed about the flower pot 16, portions of the decorative covering 18 extend circumferentially about and substantially encompass at least a portion of the sidewall 96 of the flower pot 16. In this position, the decorative covering 18 extends angularly and outwardly from the sidewall 96 of the flower pot 16, generally between the upper end 90 and the lower end 92 thereof.

Figure 6:
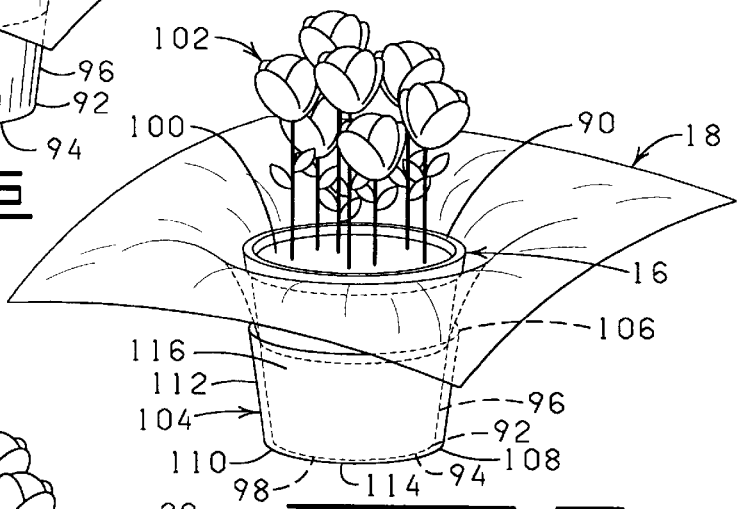
FIG. 6 is a perspective view of the flower pot having the decorative covering of FIG. 5 disposed thereabout wherein one embodiment of a cover bottom is disposed about a lower end of the flower pot such that an upper end of the cover bottom is disposed substantially adjacent the decorative covering.

Referring now to FIG. 6, shown therein is the flower pot 16 having the decorative covering 18 formed thereabout from one sheet of material 14 detached from the decorative covering assembly 10. A cover bottom 104 is disposed about the lower end 92 of the flower pot 16. The cover bottom 104 is typically constructed of a non-porous decorative material so that the cover bottom 104 functions not only to decorate the flower pot 16 but also to minimize the damage which may occur to a supporting structure as a result of the spillage of water and/or potting medium from the flower pot 16. The cover bottom 104 has an upper end 106, a lower end 108, a closed bottom 110 and a continuous sidewall 112 extending upwardly from about a periphery 114 of the closed bottom 110 thereof. The sidewall 112 and the closed bottom 110 of the cover bottom 104 cooperate to define a receiving space 116 which is shaped and dimensioned to receive the lower end 92 of the flower pot 16 such that the sidewall 112 of the cover bottom 104 extends over at least a portion of the sidewall 96 of the flower pot 16 and the closed bottom 110 of the cover bottom 104 is disposed substantially adjacent the bottom 94 of the flower pot 16. In this position, the upper end 106 of the cover bottom 104 is disposed substantially adjacent the decorative covering 18 formed from the sheets of material 14 of the decorative covering assembly 10 to maintain the decorative covering 18 in a stable position about the flower pot 16. If desired, the cover bottom 104 may be shaped and dimensioned so that the cover bottom 104 can be secured to the flower pot 16 by frictional engagement of the cover bottom 104 with the flower pot 16, or with a suitable bonding material (not shown) applied to the cover bottom 104 and/or the flower pot 16.

Figure 7:
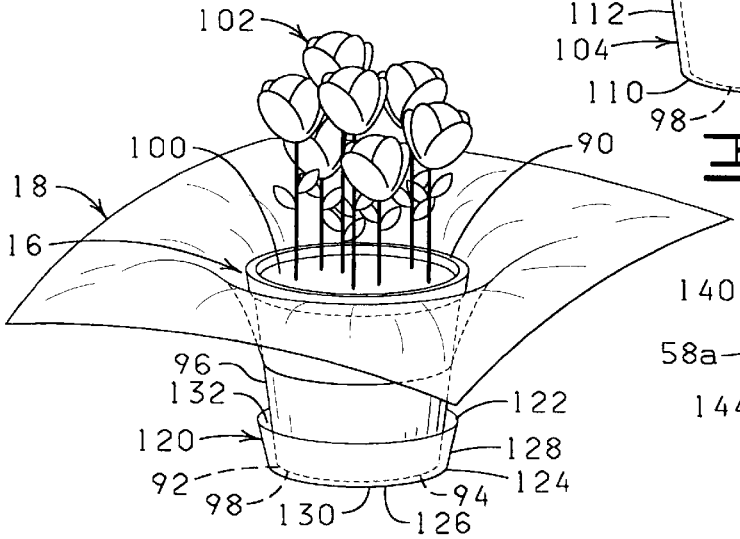
FIG. 7 is a perspective view of the flower pot having the decorative covering of FIG. 5 disposed thereabout wherein another embodiment of a cover bottom is disposed about the lower end of the flower pot such that an upper end of the cover bottom is spaced a distance from the decorative covering.

Referring now to FIG. 7, shown therein is the flower pot 16 having the decorative covering 18 disposed thereabout wherein the decorative covering 18 is formed of one sheet of material 14 detached from the decorative covering assembly 10. A cover bottom 120 is disposed about the lower end 92 of the flower pot 16. The cover bottom 120 is typically constructed of a non-porous decorative material so that the cover bottom 120 functions not only to decorate the flower pot 16 but also to minimize the damage which may occur to a supporting structure as a result of the spillage of water and/or potting medium from the flower pot 16. The cover bottom 120 has an upper end 122, a lower end 124, a closed bottom 126 and a substantially continuous sidewall 128 extending upwardly from about a periphery of the closed bottom 126 thereof. The closed bottom 126 and the continuous sidewall 128 of the cover bottom 120 cooperate to define a receiving space 132 which is shaped and dimensioned to receive the lower end 92 of the flower pot 16.

In use, the lower end 92 of the flower pot 16 is disposed in the receiving space 132 of the cover bottom 120 so that the closed bottom 126 of the cover bottom 120 is disposed generally adjacent the bottom 94 of the flower pot 16 and the continuous sidewall 128 of the cover bottom 120 extends over a portion of the sidewall 96 of the flower pot 16 generally adjacent the lower end 92 of the flower pot 16. The upper end 122 of the cover bottom 120 is disposed a distance from the decorative covering 18 formed about the flower pot 16 from the sheet of material 14. If desired, the cover bottom 120 may be shaped and dimensioned so that the cover bottom 120 can be secured to the flower pot 16 by frictional engagement of the cover bottom 120 with the flower pot 16, or with a suitable bonding material (not shown) applied to the cover bottom 120 and/or the flower pot 16.

It should be noted that while the holder assembly 70 has been shown as having a plurality of spatially disposed prongs 80 for securing the respective header assemblies 12 and the header connector assembly 58 of the decorative covering assembly 10 to the holder assembly 70, any suitable connector means for securing the respective header assemblies 12 and/or the header connector assembly 58 of the decorative covering assembly 10 to the substantially upright member 74 of the holder assembly 70 while permitting at least one sheet of material 14 to be readily detached from its respective header assembly 12 can be employed. For example, suitable connector means for securing the header assemblies 12 and/or the header connector assembly 58 to the holder assembly 70 can be clamps, clips, hooks, ring binders, or the like.

Further, while the holder assembly 70 has been shown as having the base member 72 and the substantially upright member 74 cooperating to hold the decorative covering assembly 10, it should be understood that the holder assembly 70 may be provided with any suitable structure capable of holding the decorative covering assembly 10 so as to permit at least one of the sheets of material 14 to be detachably removed from its respective header assembly 12 when desired.

FIG. 8

Figure 8:
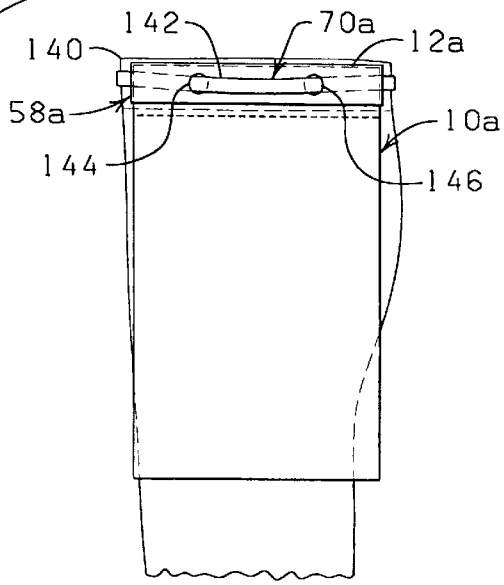
FIG. 8 is a perspective view of a belt holding a second embodiment of a decorative covering assembly constructed in accordance with the present invention.

Referring now to FIG. 8, shown therein is a holder assembly 70*a* which is constructed in accordance with the present invention and which supports a second embodiment of a decorative covering assembly 10*a* about the waist of an individual 140. The holder assembly 70*a* includes a belt 142. The decorative covering assembly 10*a* is substantially identical in construction as the decorative covering assembly 10 hereinbefore described with reference to FIGS. 1–4 with the exception that respective header assemblies 12*a* and a header connector assembly 58*a* of the decorative covering assembly 10*a* are provided with a first opening 144 and a second opening 146 formed therethrough which are shaped and dimensioned to receive the belt 142 for securing the decorative covering assembly 10*a* to the waist of the individual 140.

FIGS. 9–10

Figure 9:
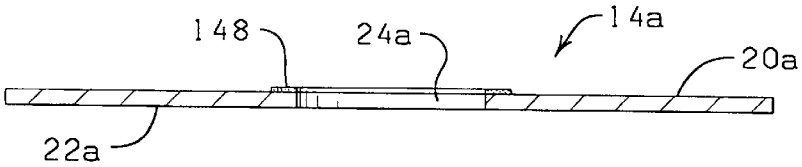
FIG. 9 is a cross-sectional view of another embodiment of a sheet of material which is shown as being detached from a decorative covering assembly which is similar to the decorative covering assembly of FIG. 1 or the decorative covering assembly of FIG. 8 wherein the sheet of material has a bonding material applied to an upper surface thereof.

Referring now to FIG. 9, shown therein and designated by the reference numeral 14*a* is a cross-sectional view of a second embodiment of a sheet of material which is shown as being detached from a header assembly (not shown). The sheet of material 14*a* is detachably connected to its respective header assembly (not shown) in substantially the same manner as each of the sheets of material 14 is connected to its respective header assembly 12, as described hereinbefore with reference to FIGS. 1–5. In one embodiment, a line of perforations (not shown) is provided between the sheet of material 14*a* and its respective header assembly for detachably connecting the sheet of material 14*a* to its respective header assembly. Once detached from its respective header assembly, the sheet of material 14*a* can be disposed about the flower pot 16 to provide the flower pot 16 with a decorative covering 18*a* (FIG. 10), as will be described hereinafter.

The sheet of material 14*a* is substantially identical in construction and use as the sheet of material 14 hereinbefore described with reference to FIGS. 1–7, except that the sheet of material 14*a* is provided with a bonding material 148 applied to an upper surface 20*a* of the sheet of material 14*a* and generally adjacent an opening 24*a* provided through the sheet of material 14*a*. Although the bonding material 148 has been shown in FIG. 9 as being applied generally about the opening 24*a* on the upper surface 20*a* of the sheet of material 14*a*, it should be understood that the bonding material 148 can be applied to the entire upper surface 20*a* and/or lower surface 22*a* of the sheet of material 14*a* and/or in strips or spots about only a portion of the upper surface 20*a* and/or lower surface 22*a* of the sheet of material 14*a*. The thickness of the bonding material 148 is greatly exaggerated in FIG. 9 for purposes of clarity.

Figure 10:
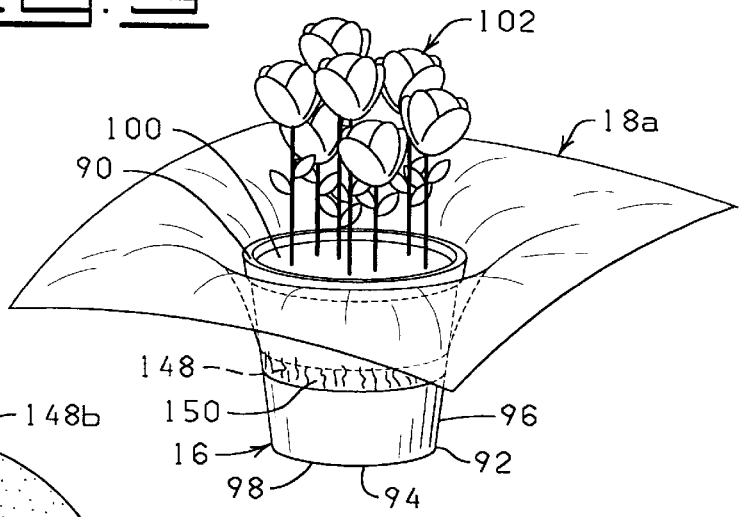
FIG. 10 is perspective view of the sheet of material of FIG. 9 wherein the sheet of material is disposed about the flower pot to provide a decorative covering for the flower pot.

When the sheet of material 14*a* is disposed about the sidewall 96 of the flower pot 16 to provide the decorative covering 18*a* (FIG. 10), the bonding material 148 contacts the sidewall 96 of the flower pot 16 and secures the decorative covering 18*a* to the flower pot 16 substantially as shown in FIG. 10. Once the sheet of material 14*a* is disposed about the sidewall 96 of the flower pot 16 to form the decorative covering 18*a*, the decorative covering 18*a* can be pressed about the sidewall 96 thereof so that overlapping portions of the decorative covering 18*a* having the bonding material 148 applied thereto are bondingly connected to form a plurality of bondingly connected crimped portions 150 in the decorative covering 18*a* to enhance the decorative effect of the decorative covering 18*a*. Thus, the bonding material 148 serves not only to enhance the decorative effect of the decorative covering 18*a* but also to secure the decorative covering 18*a* to the flower pot 16.

Once the sheet of material 14*a* is disposed about the flower pot 16 to form the decorative covering 18*a*, the flower pot 16 can be disposed in the receiving space 116 of the cover bottom 104 or in the receiving space 132 of the cover bottom 120 to minimize the damage which may occur to a supporting structure as the result of the spillage of water and/or potting medium from the flower pot 16, as previously discussed with reference to FIGS. 6 and 7.

FIGS. 11–13

Figure 11:
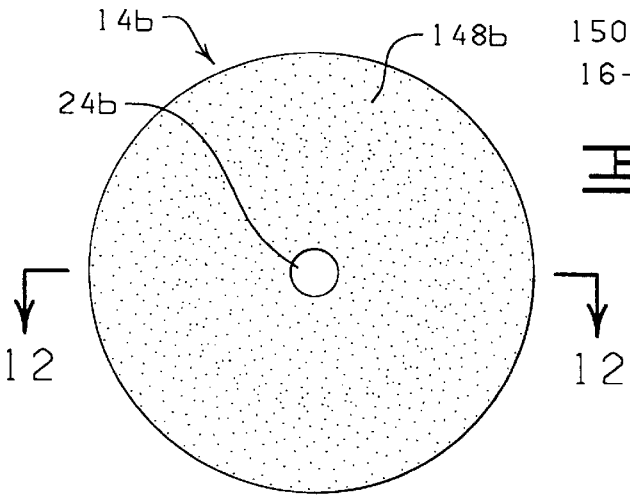
FIG. 11 is a top plan view of another embodiment of a sheet of material which is shown as being detached from a decorative covering assembly which is similar to the decorative covering assembly of FIG. 1 or the decorative covering assembly of FIG. 8.

Referring now to FIG. 11, shown therein is another embodiment of a sheet of material 14*b* which is shown as being detached from a header assembly (not shown). The sheet of material 14*b* is detachably connected to its respective header assembly in substantially the same manner as each of the sheets of material 14 is connected to its respective header assembly 12, as described hereinbefore with reference to FIGS. 1–5. That is, in one embodiment a line of perforations (not shown) is provided between the sheet of material 14*b* and its respective header assembly for detachably connecting the sheet of material 14*b* to its respective header assembly. The sheet of material 14*b* is substantially identical in construction as the sheet of material 14 which was hereinbefore described with reference to FIG. 1, except that the sheet of material 14*b* is provided with a circular configuration and has a bonding material 148*b* applied to a portion of an upper surface 20*b* (FIG. 12) of the sheet of material 14*b*, and an opening 24*b* shaped and dimensioned to receive at least a portion of the floral grouping 102*a* (FIGS. 12 and 13) formed through a central portion of the sheet of material 14*b*.

Figure 12:
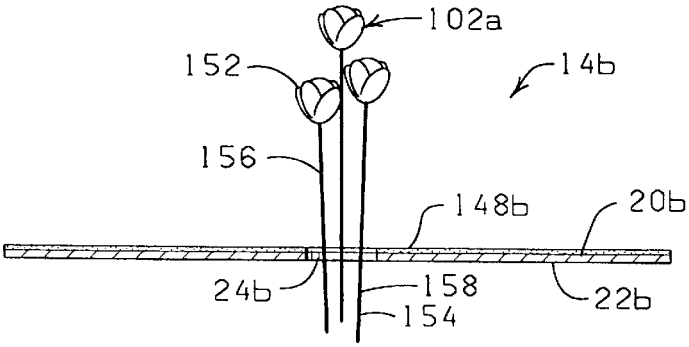
FIG. 12 is a cross-sectional view of the sheet of material of FIG. 11 taken along the lines 12—12 wherein a stem portion of a floral grouping is disposed through the opening formed in the sheet of material.

As shown in FIGS. 11 and 12, the bonding material 148*b* is applied substantially to the entire upper surface 20*b* of the sheet of material 14*b*. However, it should be understood that the bonding material 148*b* can be applied to the sheet of material 14*b* in strips or spots and may cover only a portion of the upper surface 20*b* and/or a lower surface 22*b* of the sheet of material 14*b*. The thickness of the bonding material 148*b* is greatly exaggerated in FIG. 12 for purposes of clarity.

Figure 13:
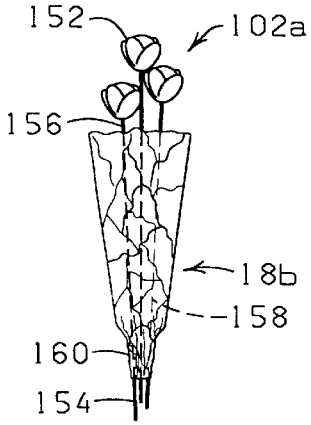
FIG. 13 is a pictoral representation of a decorative covering formed about a floral grouping from the sheet of material of FIG. 11.

Referring now to FIG. 12 in combination with FIG. 13, a floral grouping 102*a* is illustrated. The floral grouping 102*a* has a bloom end 152 and an opposed stem 154 end spaced a distance from the bloom end 152 thereof. The floral grouping 102*a* can be further characterized as having an upper portion 156 and a lower portion 158. The upper portion 156 of the floral grouping 102*a* is disposed near the bloom end 152 thereof. The lower portion 158 of the floral grouping 102*a* is disposed near the stem end 154 thereof.

To form the sheet of material 14*b* about the floral grouping 102*a* to provide a decorative covering 18*b* thereabout, the stem end 154 of the floral grouping 102*a* is disposed through the opening 24*b* in the sheet of material 14*b* to a position wherein a portion of the stem end 154 of the floral grouping 102*a* extends through the opening 24*b* and a distance beyond the lower surface 22*b* of the sheet of material 14*b*. The sheet of material 14*b* is then formed about the floral grouping 102*a* such that the upper surface 20*b* of the sheet of material 14*b* is disposed substantially adjacent the floral grouping 102*a* and the sheet of material 14*b* substantially encompasses the floral grouping 102*a* while a portion of the stem end 154 of the floral grouping 102*a* extends beyond a lower end 160 of the decorative covering 18*b* substantially as shown in FIG. 13.

Desirably, the sheet of material 14*b* is tightly folded or wrapped about the lower portion 158 of the floral grouping 102*a* while forming the decorative covering 18*b* about the floral grouping 102*a*. It should be noted that as the sheet of material 14*b* is formed about the floral grouping 102*a*, portions of the sheet of material 14*b* having the bonding material 148*b* thereon are brought into contact and bonded with adjacent portions of the sheet of material 14*b* having the bonding material 148*b* thereon for securing the decorative covering 18*b* in a tightly wrapped position about the lower portion 158 of the floral grouping 102*a*. Further, as the sheet of material 14*b* is formed about the upper portion 156 of the floral grouping 102*a*, portions of the sheet of material 14*b* having the bonding material 148*b* thereon are brought into contact and bonded with overlapping and adjacent portions of the sheet of material 14*b* with the bonding material 148*b* thereon to form bonded overlapping folds in the decorative covering 18*b* which serve not only to enhance the decorative effect of the decorative covering 18*b* but also to secure the decorative covering 18*b* in a loosely wrapped position about the upper portion 156 of the floral grouping 102*a*.

It should also be noted that when the bonding material 148*b* is applied to the upper surface 20*b* of the sheet of material 14*b*, portions of the sheet of material 14*b* having the bonding material 148*b* thereon are also brought into contact with and bonded to portions of the lower portion 158 of the floral grouping 102*a* thereby bonding the sheet of material 14*b* to the floral grouping 102*a* generally about the lower portion 158 for securing the decorative covering 18*b* to the floral grouping 102*a* and for substantially preventing the floral grouping 102*a* from sliding out from or moving in a vertical direction within the decorative covering 18*b*. Therefore, the bonding material 148*b* serves not only to enhance the decorative effect of the decorative covering 18*b* but also to secure the decorative covering 18*b* to and about the floral grouping 102*a*.

While the sheet of material 14*b* and the method of forming the sheet of material 14*b* about the floral grouping

102*a* to provide the decorative covering 18*b* about the floral grouping 102*a* has been shown and described herein with reference to the bonding material 148*b* being applied to the upper surface 20*b* of the sheet of material 14*b,* it should be noted that the bonding material 148*b* may be applied to the sheet of material 14*b* in various locations and configurations and thereafter formed about the floral grouping 102*a* substantially as shown in U.S. Pat. No. 5,311,991 issued to Weder et al. on May 17, 1994 which is incorporated herein by reference.

FIGS. 14–16

Figure 14:
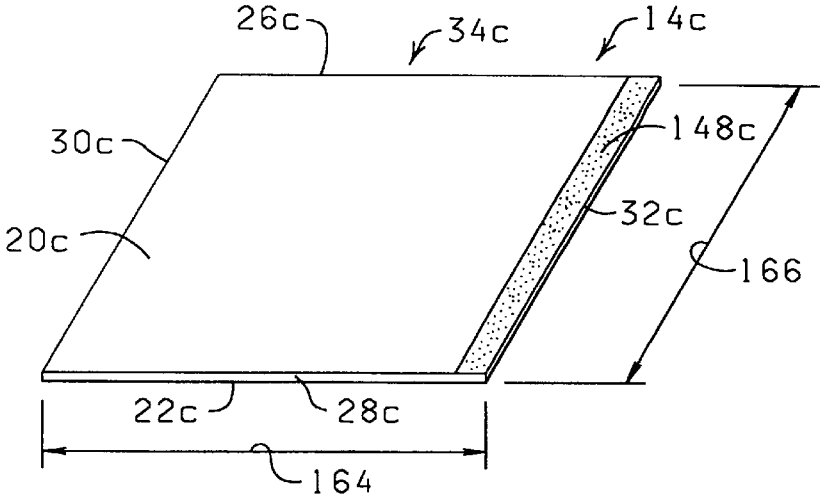
FIG. 14 is a perspective view of another embodiment of a sheet of material which is shown as being detached from a decorative covering assembly which is similar to the decorative covering assembly of FIG. 1 or the decorative covering assembly of FIG. 8.

Referring now to FIG. 14, shown therein is another embodiment of a sheet of material 14*c* which is shown as being detached from a header assembly (not shown). The sheet of material 14*c* is detachably connected to its respective header assembly in substantially the same manner as each of the sheets of material 14 is connected to its respective header assembly 12, as described hereinbefore with reference to FIGS. 1–5. That is, in one embodiment a line of perforations (not shown) is provided between the sheet of material 14*c* and its respective header assembly for detachably connecting the sheet of material 14*c* to its respective header assembly.

The sheet of material 14*c* has an upper surface 20*c,* a lower surface 22*c,* a first end 26*c,* an opposed second end 28*c* spaced a distance from the first end 26*c,* a first side 30*c* and an opposed second side 32*c* spaced a distance from the first side 30*c*. The first end 26*c,* second end 28*c,* first side 30*c* and second side 32*c* cooperate to provide the sheet of material 14*c* with a periphery 34*c*. A bonding material 148*c* is applied to at least a portion of the upper surface 20*c* and/or the lower surface 22*c* of the sheet of material 14*c*. As shown in FIG. 14, in one embodiment the bonding material 148*c* can be characterized as a strip of adhesive extending near the second side 32*c* of the sheet of material 14*c* and generally between the first and second ends 26*c* and 28*c* thereof.

The sheet of material 14*c* has a length 164 and a width 166 which are both sized to permit the sheet of material 14*c* to be wrapped about the flower pot 16 (FIG. 16) or a floral grouping (not shown) to provide a decorative covering 18*c* thereabout. The length 164 of the sheet of material 14*c* extends generally between the first side 30*c* and the second side 32*c* thereof. The width 166 of the sheet of material extends generally between the first end 26*c* and the second end 28*c* thereof.

Figure 15:
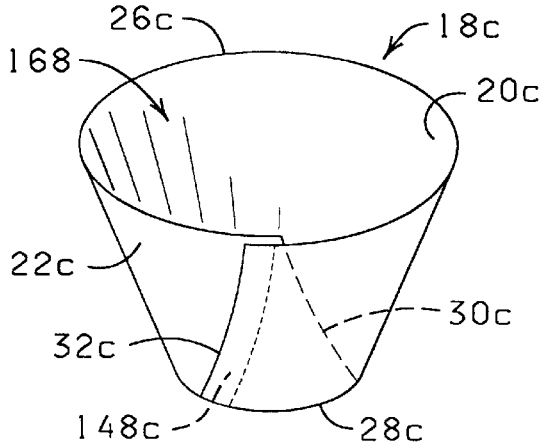
FIG. 15 is a perspective view of a preformed decorative cover for a flower pot wherein the preformed decorative cover is formed from the sheet of material of FIG. 14.
Figure 16:
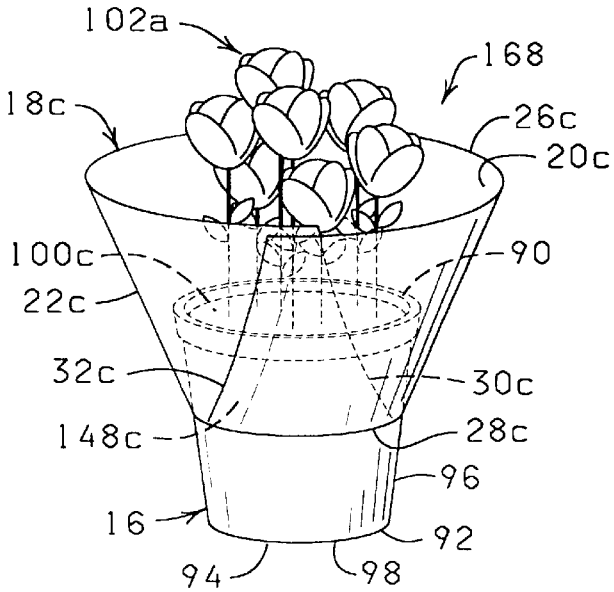
FIG. 16 is a perspective view of the preformed decorative cover of FIG. 15 wherein the preformed decorative cover is disposed about a flower pot.

Referring now to FIG. 14 in combination with FIGS. 15 and 16, a method for forming the sheet of material 14*c* about the flower pot 16 to provide the decorative covering 18*c* will now be described. At least one of the sheets of material 14*c* is detached from its respective header assembly and thereafter formed into the shape of a loop (FIG. 15) such that the first side 30*c* of the sheet of material 14*c* extends past the second side 32*c* thereof in an overlapping fashion and the bonding material 148*c* contacts the lower surface 22*c*of the sheet of material 14*c* to provide a preformed decorative covering 18*c* for the flower pot 16. In this position, the preformed decorative covering 18*c* forms a pot receiving opening 168 which is shaped and dimensioned to receive at least a portion of the flower pot 16 or the floral grouping 102*a* therethrough. As shown in FIG. 16, the lower end 92 of the flower pot 16 is disposed through the pot receiving opening 168 of the preformed decorative covering 18*c* until the preformed decorative covering 18*c* engages the sidewall 96 of the flower pot 16 and extends angularly therefrom, substantially as shown in FIG. 16.

Once the decorative covering 18*c* has been disposed about the flower pot 16, the flower pot 16 can be disposed in the receiving space 116 of the cover bottom 104 or in the receiving space 132 of the cover bottom 120 to minimize the damage which may occur to a supporting structure as a result of the spillage of water and/or potting medium from the flower pot 16, as previously discussed with reference to FIGS. 6 and 7.

The sheet of material 14*c* can also be wrapped about a floral grouping to form a decorative covering (not shown) thereabout substantially as shown in U.S. Pat. No. 5,448,875 issued to Weder on Sep. 12, 1995 which is hereby incorporated by reference.

The sheet of material 14*c* is constructed from any suitable material that is capable of being wrapped about the flower pot 16 or the floral grouping 102*a* as described herein. Desirably, the sheet of material 14*c* is constructed of paper (untreated or treated in any manner), cellophane, foil, man-made organic polymer film, cloth (natural or synthetic), burlap (natural or synthetic), cling wrap or combinations thereof.

Although the sheet of material 14*c* has been shown and described herein as having a substantially rectangular shape, it should be understood that the sheet of material 14*c* may assume any geometric, non-geometric or asymmetrical shape and any appropriate size so long as the sheet of material 14*c* can be disposed about the flower pot 16 or the floral grouping 102*a*. For example, the sheet of material 14*c* may be square, rectangular, circular, heart-shaped or the like.

While the sheet of material 14*c* and the method for wrapping the sheet of material 14*c* about the flower pot 16 or the floral grouping 102*a* has been shown and described herein with reference to the sheet of material 14*c* having the bonding material 148*c* (strip of adhesive) extending near the second side 32*c* of the sheet of material 14*c,* it should be understood that the bonding material 148*c* may be applied to the entire upper surface 20*c* and/or lower surface 22*c* of the sheet of material 14*c,* near the periphery 34*c* of the upper surface 20*c* and/or the lower surface 22*c* of the sheet of material 14*c,* and/or in fanciful patterns, strips or spots about the sheet of material 14*c* and that the sheet of material 14*c* having such various configurations of bonding materials 148*c* can be wrapped about flower pots and floral groupings substantially as shown in U.S. Pat. No. 5,245,814 issued to Weder on Sep. 21, 1993; U.S. Pat. No. 5,344,016 issued to Weder et al. on Sep. 6, 1994; U.S. Pat. No. 5,448,875 issued to Weder on Sep. 12, 1995; and U.S. Pat. No. 5,560,181 issued to Weder on Oct. 1, 1996 each of which is hereby incorporated by reference.

It should be understood that portions of the embodiments shown and described herein may be used with other portions of the embodiments shown and described herein to create additional combinations of components for the decorative covering assemblies 10 and 10*a,* and the decorative coverings 18, 18*a,* 18*b,* and 18*c*disclosed herein.

Changes may be made in the construction and operation of the various components and assemblies described herein and changes may be made in the steps or the sequence of steps of the methods described herein without departing from the spirit and the scope of the invention as defined in the following claims.

What is claimed is:

1. A method for providing a decorative covering for a flower pot, comprising:

providing a decorative covering assembly comprising a header assembly and at least one sheet of material detachably connected to the header assembly;

securing the header assembly to a holder assembly such that the decorative covering assembly is supported by the holder assembly and at least one sheet of material can be detached from the header assembly;

securing the holder assembly to an individual so as to maintain the individual's hands unconstrained;

detaching at least one sheet of material from the header assembly; and disposing the respective sheet of material about at least a portion of the flower pot to provide the decorative covering for the flower pot.

2. The method of claim 1, wherein each of the sheets of material has an opening formed therethrough and wherein the step of disposing the sheet about at least a portion of the flower pot includes the step of disposing at least a portion of the flower pot within the opening of at least one sheet of material such that the sheet of material is disposed about at least a portion of the flower pot.

3. The method of claim 2, wherein the step of disposing the respective sheet of material about at least a portion of the flower pot is defined further as disposing at least a portion of the flower pot within the opening of at least one sheet of material such that the sheet of material is secured about at least a portion of the flower pot by frictional engagement with one of at least one sheet of material, at least a portion of the flower pot, and combinations thereof.

4. The method of claim 1, wherein the step of detaching at least one sheet of material from the header assembly includes the step of tearing at least one sheet of material from the header assembly along a line of perforations disposed between the sheet of material and the header assembly.

5. The method of claim 1, wherein in the step of securing the header assembly to a holder assembly, the holder assembly is a belt and wherein the step of securing the header assembly to a holder assembly is defined further as threading the belt through an opening provided in the header assembly of the decorative covering assembly.

6. The method of claim 1, wherein the holder assembly is transportable, the method further comprising the step of transporting the decorative covering assembly to a predetermined location for dispersion of at least one sheet of material.

7. The method of claim 1, wherein the holder assembly is transportable via an individual, the method further comprising the step of transporting the decorative covering assembly via an individual to a predetermined location for dispersion of at least one sheet of material.

8. The method of claim 1, wherein the sheet of material is connected to the header assembly via a bonding material selected from the group consisting of adhesives, cohesives, and combinations thereof.

9. The method of claim 1, wherein the step of disposing the sheet of material about at least a portion of the flower pot includes the step of overlapping at least a portion of the sheet of material over at least another portion of the sheet of material to form at least one crimped portion such that the sheet of material is secured about at least a portion of the flower pot.

10. A method for providing a decorative covering for a flower pot having an upper end, a lower end and a sidewall extending generally between the upper end and the lower end thereof, comprising:

providing a decorative covering assembly comprising a header assembly and at least one sheet of material detachably connected to the header assembly, the sheet of material having an opening therethrough;

securing the header assembly to a holder assembly such that the decorative covering assembly is supported by the holder assembly and at least one sheet of material can be detached from the header assembly;

securing the holder assembly to an individual so as to maintain the individual's hands unconstrained;

detaching at least one sheet of material from the header assembly;

disposing at least a portion of the flower pot within the opening of at least one sheet of material so as to provide the decorative covering for the floral grouping.

11. The method of claim 10, further comprising the steps of:

providing a cover bottom defining a receiving space, the cover bottom having an upper end, a lower end, a bottom, and a sidewall extending generally between the upper and the lower ends; and disposing a lower end of the flower pot into the receiving space of the cover bottom such that the cover bottom extends a distance above the lower end of the flower pot.

12. The method of claim 11, wherein the step of disposing the lower end of the flower pot into the receiving space of the cover bottom is defined further as disposing at least a portion of the lower end of the flower pot into the receiving space of the cover bottom such that the cover bottom extends a distance above the lower end of the flower pot and the upper end of the cover bottom is substantially adjacent at least a portion of the decorative covering thereby securing the decorative covering about at least a portion of the sidewall of the flower pot.

13. The method of claim 11, wherein the step of disposing the lower end of the flower pot into the receiving space of the cover bottom, further comprises disposing at least a portion of the lower end of the flower pot into the receiving space of the cover bottom such that the cover bottom extends a distance above the lower end of the flower pot and the upper end of the cover bottom is disposed a distance from the decorative covering.

14. The method of claim 11, wherein the cover bottom comprises a bonding material disposed on at least a portion of the cover bottom and wherein the step of disposing the lower end of the flower pot into the receiving space of the cover bottom further comprises disposing at least a portion of the lower end of the flower pot into the receiving space of the cover bottom such that the cover bottom extends a distance above the lower end of the flower pot and the cover bottom is bondingly secured to one of at least a portion of the sheet of material, at least a portion of the sidewall of the flower pot, and combinations thereof.

15. A method for providing a decorative covering for a flower pot having an upper end, a lower end, a bottom, and a sidewall extending generally between the upper and lower ends of the flower pot, comprising:

providing a decorative covering assembly comprising a header assembly and at least one sheet of material detachably connected to the header assembly, the sheet of material having a first end and a second end;

securing the header assembly to the holder assembly such that the decorative covering assembly is supported by the holder assembly and at least one sheet of material can be detached from the header assembly;

securing the holder assembly to an individual so as to maintain the individual's hands unconstrained;

detaching at least one sheet of material from the header assembly;

connecting at least a portion of the first end of the sheet of material to at least a portion of the second end of the sheet of material thereby forming the sheet of material into a preformed decorative covering having an opening therethrough; and disposing at least a portion of the flower pot within the opening formed by the at least one sheet of material such that the sheet of material is disposed about at least a portion of the sidewall of the flower pot to provide a decorative covering for the flower pot.

16. A method for providing respective decorative coverings for a plurality of flower pots, comprising:

providing a decorative covering assembly comprising a header assembly and at least one sheet of material detachably connected to the header assembly;

securing the header assembly to a holder assembly such that the decorative covering assembly is supported by the holder assembly and at least one sheet of material can be detached from the header assembly;

securing the holder assembly to an individual such that the decorative covering assembly is supported in a vertical direction;

transporting, via the individual, the decorative covering assembly to a first location adjacent a first flower pot;

detaching a first sheet of material from the header assembly while the holder assembly is secured to the individual;

disposing the first sheet of material about at least a portion of a first flower pot to provide a decorative covering for the first flower pot;

transporting, via the individual, the decorative covering assembly to a second location adjacent a second flower pot;

detaching a second sheet of material from the header assembly while the holder assembly is secured to the individual; and disposing the second sheet of material about at least a portion of the second flower pot to provide a decorative covering for the second flower pot.

* * * * *

UNITED STATES PATENT AND TRADEMARK OFFICE

CERTIFICATE OF CORRECTION

PATENT NO. : 6,363,688 B1 
DATED : April 2, 2002
INVENTOR(S) : Donald E. Weder et al.

It is certified that error appears in the above-identified patent and that said Letters Patent is hereby corrected as shown below:

Drawings,
Fig. 16, please replace with new Fig. 16 as follows:

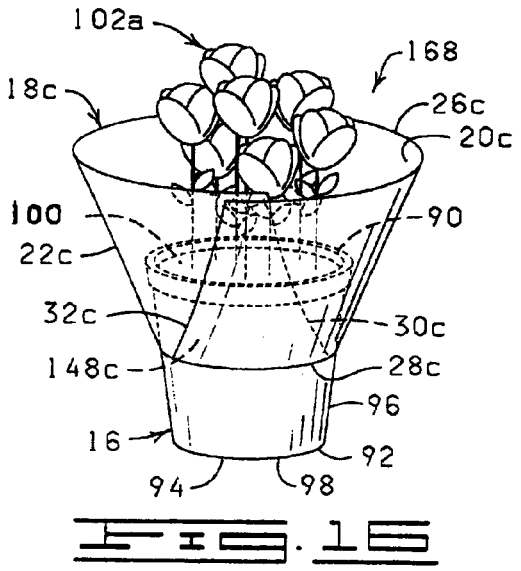

FIG. 16

Signed and Sealed this

Seventh Day of September, 2004

JON W. DUDAS
*Director of the United States Patent and Trademark Office*